US006354088B1

(12) United States Patent
Emmer et al.

(10) Patent No.: US 6,354,088 B1
(45) Date of Patent: Mar. 12, 2002

(54) SYSTEM AND METHOD FOR DISPENSING CRYOGENIC LIQUIDS

(75) Inventors: Claus Emmer, Prior Lake; Tom Drube, Lakeville, both of MN (US); Keith Gustafson, Waleska, GA (US)

(73) Assignee: Chart Inc., Burnsville, MN (US)

( * ) Notice: Subject to any disclaimer, the term of this patent is extended or adjusted under 35 U.S.C. 154(b) by 0 days.

(21) Appl. No.: 09/687,767

(22) Filed: Oct. 13, 2000

(51) Int. Cl.[7] ..... F17C 7/02
(52) U.S. Cl. ..... 62/50.1; 141/82
(58) Field of Search ..... 62/50.1; 141/82

(56) References Cited

U.S. PATENT DOCUMENTS

| | | | |
|---|---|---|---|
| 3,633,372 A | | 1/1972 | Torrance |
| 3,946,572 A | | 3/1976 | Bragg |
| 5,107,906 A | | 4/1992 | Swnson et al. |
| 5,121,609 A | | 6/1992 | Cieslukowski |
| 5,127,230 A | | 7/1992 | Neeser et al. |
| 5,163,409 A | | 11/1992 | Gustafson et al. |
| 5,228,295 A | | 7/1993 | Gustafson |
| 5,231,838 A | | 8/1993 | Cieslukowski |
| 5,315,831 A | | 5/1994 | Goode et al. |
| 5,373,702 A | | 12/1994 | Kalet et al. |
| 5,409,046 A | | 4/1995 | Swenson et al. |
| 5,411,374 A | | 5/1995 | Gram |
| 5,421,160 A | | 6/1995 | Gustafson et al. |
| 5,421,162 A | | 6/1995 | Gustafson et al. |
| 5,537,824 A | | 7/1996 | Gustafson et al. |
| 5,682,750 A | | 11/1997 | Preston et al. |
| 5,687,776 A | | 11/1997 | Forgash et al. |
| 5,771,946 A | | 6/1998 | Kooy et al. |
| 5,771,948 A | | 6/1998 | Kountz et al. |
| 5,787,940 A | | 7/1998 | Bonn et al. |
| 5,868,176 A | | 2/1999 | Barajas et al. |
| 5,884,488 A | | 3/1999 | Gram et al. |
| 5,916,246 A | * | 6/1999 | Viegas et al. ..... 62/50.1 |
| 5,954,101 A | * | 9/1999 | Drube et al. ..... 62/50.1 |

* cited by examiner

*Primary Examiner*—Ronald Capossela
(74) *Attorney, Agent, or Firm*—Piper Marbury Rudnick & Wolfe

(57) ABSTRACT

A system for dispensing cryogenic liquid to a use device tank from a bulk storage tank containing a supply of cryogenic liquid features a pump in communication with the bulk storage tank, a dispensing line in communication with the pump and a heater in communication with the dispensing line. A system control device controls the operation of the pump and heater. A liquid level sensor and temperature or pressure sensor communicate with the use device tank and the system control device and the system control device. As a result, the conditions of the cryogenic liquid initially in the use device tank may be used by the system control device to calculate the appropriate amount of cryogenic liquid and heat that should be added to the cryogenic liquid as it is dispensed so that the use device tank becomes substantially filled with saturated cryogenic liquid. A liquid level sensor may alternatively be used as the sole use device tank sensor.

29 Claims, 6 Drawing Sheets

SYSTEM AND METHOD FOR DISPENSING CRYOGENIC LIQUIDS

BACKGROUND OF THE INVENTION

The invention relates generally to cryogenic fluid dispensing systems and, more particularly, to a cryogenic liquid fuel dispensing system that utilizes sensor data from a use device receiving the fuel to optimize saturation as the fuel is delivered to a use device fuel tank.

Current alternative fuels include cryogenic substances such as Liquified Natural Gas (LNG). Cryogenic substances have a boiling point generally below −150° C. A use device, such as an LNG-powered vehicle, may need to store LNG in an on-board fuel tank with a pressure head that is adequate for the vehicle engine demands. That is, the LNG can be stored in a saturated state on board the vehicle in order to maintain the desired pressure while the vehicle is in motion. This saturation generally occurs by heating the LNG prior to its introduction into the vehicle tank.

LNG is typically dispensed from a bulk storage tank to a vehicle tank by a pressurized transfer. This may be accomplished through the use of a pump, pressurized transfer vessels or a straight pressure transfer from the bulk storage tank at a higher pressure to a vehicle tank at a lower pressure.

A common method of saturating cryogenic liquids, such as LNG, is to saturate the LNG as it is stored in a conditioning tank of a dispensing station. In some instances, the conditioning tank may also be the bulk storage tank of the dispensing station. The LNG may be heated to the desired saturation temperature and pressure by removing LNG from the conditioning tank, warming it, and reintroducing it back into the conditioning tank. The LNG may be warmed, for example, by heat exchangers as illustrated in U.S. Pat. Nos. 5,121,609 and 5,231,838, both to Cieslukowski, and 5,682,750 to Preston et al. Alternatively, the LNG maybe heated to the desired saturation temperature and pressure through the introduction of warmed cryogenic gas into the conditioning tank. Such an approach is illustrated in U.S. Pat. Nos. 5,421,160, 5,421,162 and 5,537,824, all to Gustafson et al.

Saturating the LNG in a dispensing station tank presents a number of disadvantages. One disadvantage is that the vehicle tank may have a higher existing pressure head than is optimum for refueling. If cooler LNG is pumped to the vehicle tank in such situations, the vapor head in the vehicle tank collapses as it encounters the cooler LNG. Such pressure collapse does not occur if saturated LNG is pumped to the vehicle tank, however, and the dispensing station pump may not develop enough pressure to overcome the vehicle tank pressure thereby preventing fuel from flowing to the vehicle. In addition, warming LNG in the dispensing station tank reduces the hold time of the tank. The hold time of the tank is the length of time that the tank may hold the LNG without venting to relieve excessive pressure that builds as the LNG warms. Furthermore, refilling the dispensing tank when it contains saturated LNG requires specialized equipment and takes longer.

While a number of the above difficulties may be overcome by providing an interim dispensing station transfer or conditioning tank, such a system has to be tailored in dimensions and capacities to specific site conditions, that is, the amount of fills, pressures expected, etc. As a result, deviations from the design conditions still results in problems for such a system.

Another approach for saturating the LNG prior to delivery to the vehicle tank is to warm the liquid as it is transferred to the vehicle tank. Such an approach is known in the art as "Saturation on the Fly" and is illustrated in U.S. Pat. No. 5,787,940 to Bonn et al. wherein heating elements are provided to heat the LNG as it is dispensed. U.S. Pat. Nos. 5,687,776 to Forgash et al. and 5,771,946 to Kooy et al. also illustrate dispensing systems that use heat exchangers to warm cryogenic liquid fuel as it is transferred to a vehicle. While such prior art "Saturation on the Fly" systems remove the difficulties associated with saturating the dispensing station vessel, they do not address issues related to the vehicle tank pressure and temperature since the dispensed LNG fuel enters the vehicle tank at a constant, pre-set temperature.

U.S. Pat. No. 5,373,702 to Kalet et al. presents an LNG delivery system, indicated in general at 50 in FIG. 1, whereby a vehicle fuel tank is initially filled with unheated LNG from a storage tank 52 via lines 54 and 58, pump 56 and coupling 60 to purposely collapse the vapor head therein. The vehicle fuel tank features a spray head positioned in its vapor space through which the LNG from the delivery system flows. The liquid dispensing line 58 includes a pressure sensor 72 which provides an indication to a microprocessor 70 when the liquid level in the vehicle tank reaches the spray head. The microprocessor then manipulates valves 66 and 68 so that LNG is routed through line 62 and a heat exchanger 64. As a result, natural gas vapor is produced and delivered to the vehicle fuel tank so that the LNG therein is saturated. The vehicle includes an overflow tank which receives LNG that is displaced from the vehicle fuel tank as the natural gas vapor is added and saturation occurs. A disadvantage of such an arrangement, however, is the requirement that the vehicle include an overflow tank. This adds to the vehicle cost, weight and complexity. In addition, the pressure sensor 72 only provides an indication of when the back pressure of the flow into the vehicle tank increases, indicating that the vehicle tank is nearly full. As such, pressure sensor 72 does not provide an indication of what the actual pressure within the vehicle tank is.

Accordingly, it is an object of the present invention to provide a cryogenic fuel dispensing system that does not saturate the fuel in a dispensing system tank.

It is another object of the present invention to provide a cryogenic fuel dispensing system whereby fuel may be quickly dispersed at the optimal saturation temperature and pressure.

It is another object of the present invention to maximize the amount of LNG or fluid stored by adding only enough heat to the fluid to achieve the optimal final saturation, thereby creating the maximum possible stored mass of fuel.

It is another object of the present invention to provide a cryogenic fuel dispensing system that initially transfers cooler, unsaturated LNG to a vehicle tank and then saturates the fuel as it is transferred by providing variable levels of heat.

It is still another object of the present invention to provide a cryogenic fuel dispensing system that may reliably refuel vehicles without the need for vehicle-mounted overflow tanks.

It is still another object of the present invention to provide a cryogenic fuel dispensing system that uses sensor data from the vehicle tank to optimize the saturation of the fuel as it is dispensed.

These and other objects will be apparent from the following specification.

SUMMARY OF THE INVENTION

The present invention is directed to a system for dispensing cryogenic liquid to a use device tank from a bulk storage tank containing a supply of cryogenic liquid. A dispensing line is in communication with the bulk storage tank and is adapted to communicate with the use device tank. A pump and heater are in circuit with the dispensing line. A system control device, such as a microprocessor, is in communication with the pump and heater so that cryogenic liquid may be dispensed, and selectively heated as it is dispensed, to the use device tank.

A liquid level sensor and a pressure or temperature sensor communicate with the use device tank and the system control device so that the liquid level and temperature or pressure of cryogenic liquid initially in the use device tank may be determined. The system control device uses this information to calculate the amount of heat and cryogenic liquid that must be added to the use device tank to optimally fill the use device tank. The system control device then operates the heater and pump to fill the use device tank with cryogenic liquid saturated as required. Unheated cryogenic liquid is preferably initially added to the use device tank so that the vapor head therein is collapsed. Heat may then be added to the cryogenic liquid stream as it is dispensed prior to the completion of the fill to saturate the liquid and rebuild pressure in the use device tank.

The system may alternatively include only a liquid level sensor in communication with the use device tank. The liquid initially in the use device tank is assumed to be saturated and at the pressure required by the use device when such an embodiment is selected.

The pump is preferably a positive displacement pump and is submerged in cryogenic liquid housed in a sump. The heater may include a heat exchanger, electric heater, cryogenic gas or other heating arrangement.

The following detailed description of embodiments of the invention, taken in conjunction with the appended claims and accompanying drawings, provide a more complete understanding of the nature and scope of the invention.

DESCRIPTION OF THE PREFERRED EMBODIMENTS

Figure 1:
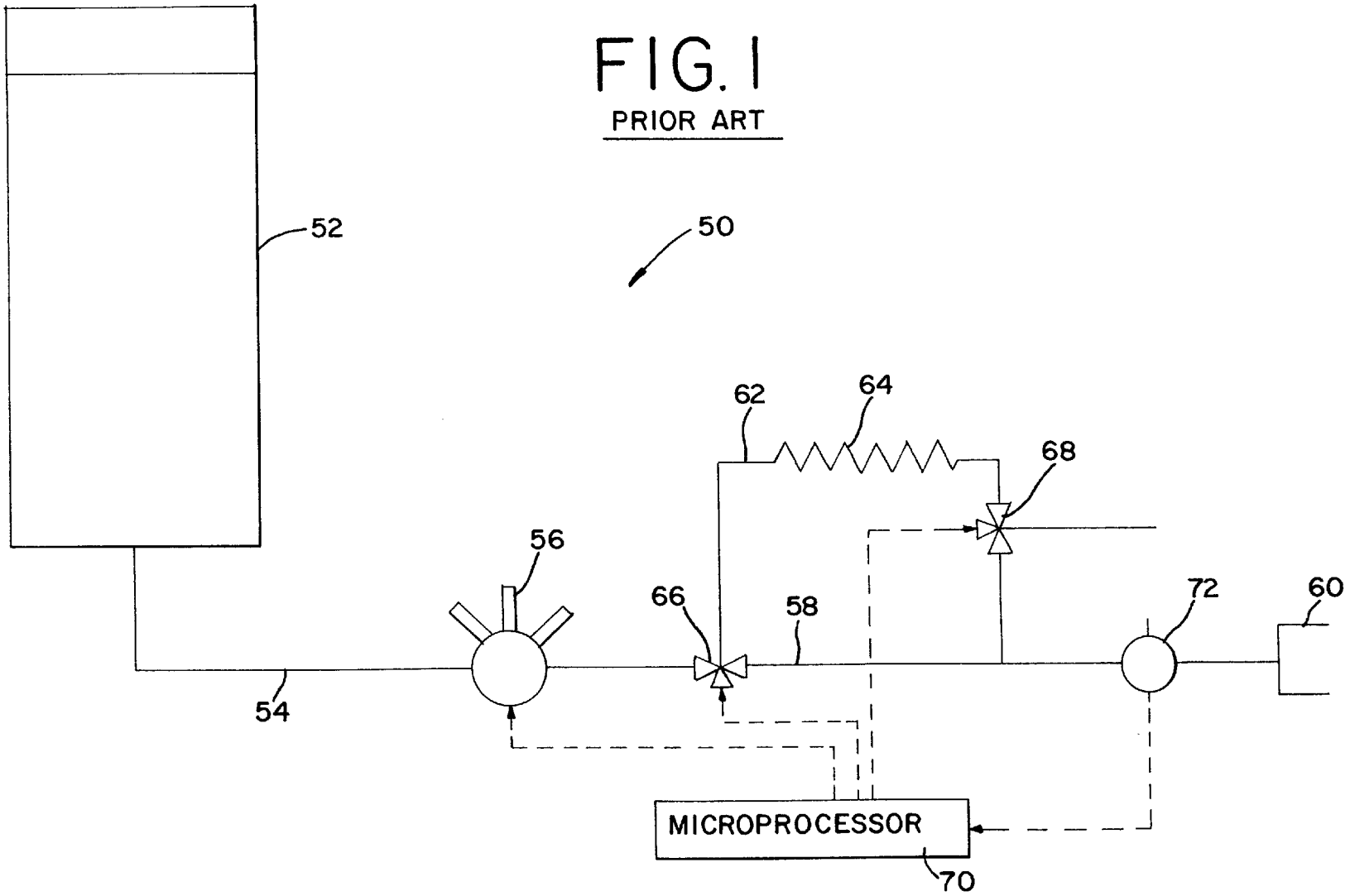
FIG. 1 PRIOR ART
FIG. 1 is a schematic of a prior art dispensing system.
Figure 2:
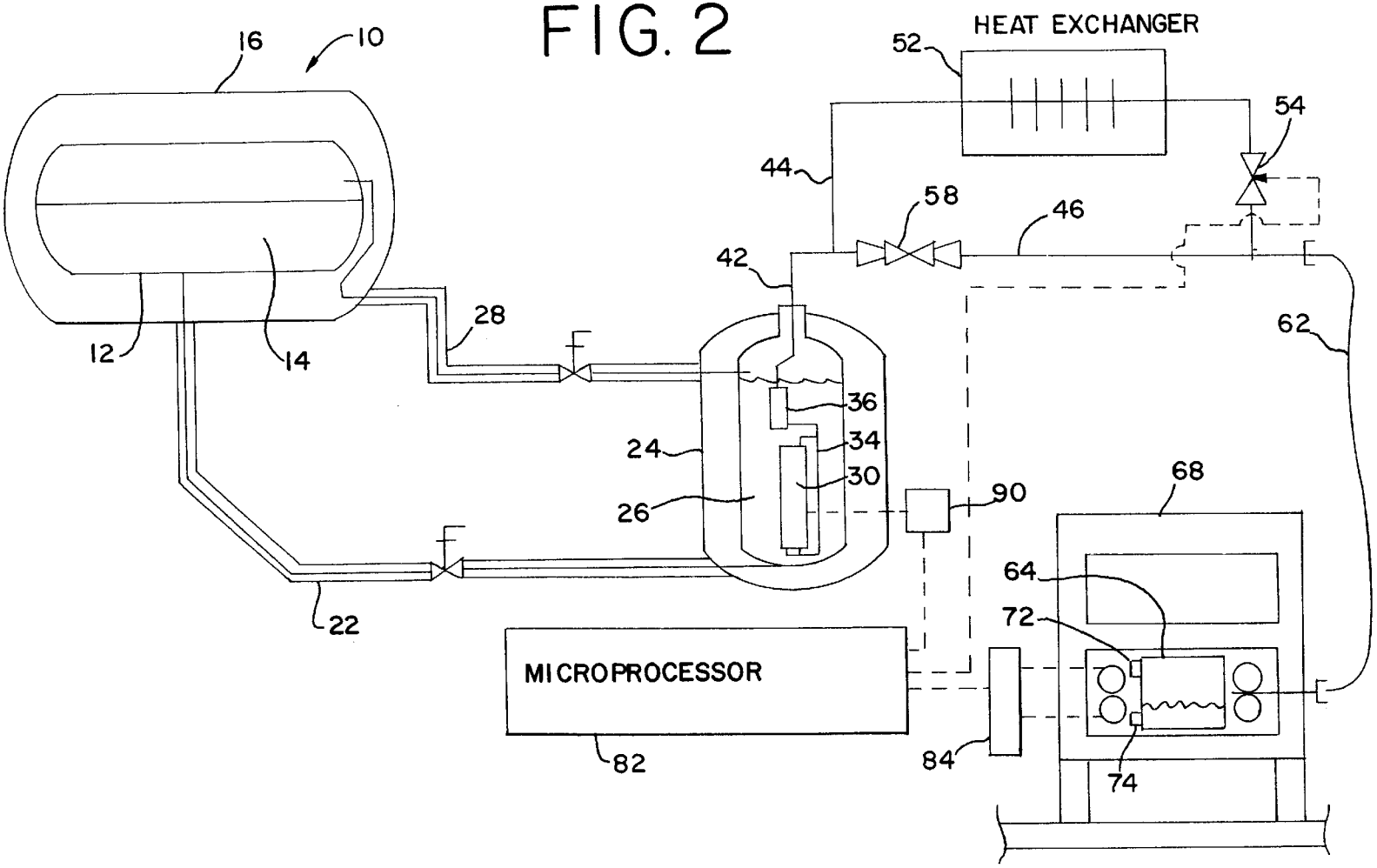
FIG. 2 is a schematic of an embodiment of the dispensing system of the present invention.

With reference to FIG. 2, an embodiment of the dispensing system of the present invention includes a bulk storage tank, indicated in general at 10. The bulk storage tank includes an inner tank 12 containing a supply of cryogenic liquid 14, such as Liquid Natural Gas (LNG). Examples of other cryogenic liquids which the invention can deliver include Liquid Oxygen, Liquid Nitrogen, Liquid Argon and Liquid Hydrogen. An outer jacket 16 surrounds the inner tank 12 and, as is known in the art, the space therebetween is generally evacuated to provide insulation.

LNG is provided via gravity and insulated feed line 22 to a sump tank 24. Sump 24 also features a double-walled construction so that the LNG 26 therein is insulated from ambient temperatures. An insulated vent or return line 28 is provided to vent excess gas from sump 24 to bulk storage tank 10. The insulation of line 28 minimizes heat transfer.

A pump 30 is positioned within sump 24 and is submerged within the LNG 26 so that no cool-down period is required when pumping is to commence. Pumped LNG travels through line 34 into a meter 36 which is also submerged in the LNG. The submersion of the meter in the LNG allows for accurate metering without a cool-down period when pumping commences. Flow measurement arrangements such as pump stroke counters may be used as alternatives to flow meter 36.

Pumped LNG travels out of sump 24 via line 42 and to lines 44 and 46. LNG traveling through line 44 passes through heat exchanger 52 and valve 54. The setting of valve 54 determines the portion of LNG that passes through line 44. A venturi 58 is positioned in line 46 to force a portion of the liquid into line 44 when valve 54 is at least partially open. LNG passing through line 44 and heat exchanger 52 is warmed and rejoins the LNG flowing through line 46 for dispensing via hose 62 to the fuel tank 64 of a use device such as a bus, truck or other vehicle 68.

Vehicle fuel tank 64 is equipped with an optional pressure sensor 72 and a liquid level sensor 74. A temperature sensor may be substituted for pressure sensor 72 or the vehicle tank may be equipped solely with a liquid level sensor. Sensors 72 and 74 communicate via electrical interface 84 with a microprocessor 82 that is co-located with the dispensing system. Alternatively, if a pressure sensor is used, the sensor could be mounted in the dispensing apparatus for measuring the tank pressure prior to commencing a dispensing operation. It should be understood the while a microprocessor is described, numerous types of system control devices known in the art could be substituted in the dispensing system of the present invention. Interface 84 may permit the data from sensors 72 and 74 to be transmitted to microprocessor 82 in a number of ways including, but not limited to, infrared, radio, detachable electrical connections or pneumatic signals. The total capacity of vehicle tank 64 and the operating pressure required by the engine of the vehicle 68 is entered into microprocessor 82 via manual entry or transmission along with the data from sensors 72 and 74. Typical operating pressures for vehicles range from approximately 70 psi to 120 psi and a temperature range from approximately −211° F. to −194° F.

Once the microprocessor 82 has received the vehicle tank capacity, operating pressure requirement, current liquid level in the vehicle tank and either current temperature or pressure in the vehicle tank, it will calculate the amount of LNG and heat that must be added to optimally fill the tank while maintaining the operating pressure of the vehicle engine. The microprocessor may alternatively perform the calculation solely from the vehicle tank capacity, operating pressure requirement and current liquid level in the vehicle tank data by assuming that the liquid remaining in the vehicle tank prior to refill is at the desired saturation pressure.

If the vehicle fuel tank includes a temperature or pressure sensor, the following equation may be utilized to calculate the amount of LNG that must be added to the vehicle tank and the amount of heat that must be added to this LNG as it is dispensed to obtain the optimum final temperature:

$$\text{Volume of liquid to add}=(V^{*}\rho(P_{sat})-M(LL))/(\rho(P_{stored}))$$

$$\text{Heat to add}=(h_f(P_{measured})-h_f(P_{stored}))*(V*\rho(P_{sat})-M(LL))+M(LL)*(h_f(P_{sat})-h_f(P_{measured}))$$

Where:

V is the volume of the vehicle tank

M(LL) is the mass of natural gas in the tank as determined by the level data $P_{sat}$ is the desired saturation pressure $P_{stored}$ is the current saturation pressure of the fuel to be delivered $P_{measured}$ is the pressure measured in the vehicle tank prior to refill $\rho(X)$ is the density of LNG at the desired saturation pressure $h_f(X)$ is the specific enthalpy of the liquid at the specified pressure ($P_{measured}$, $P_{sat}$ or $P_{stored}$)

As illustrated above, $P_{measured}$ is used when a pressure sensor is present. $P_{measured}$ is replaced with $T_{measured}$ when a temperature sensor is used in place of the pressure sensor.

If the vehicle fuel tank includes only a liquid level sensor (no pressure or temperature sensor for the vehicle tank), the following equations may be utilized to calculate the amount of LNG that must be added to the vehicle tank and the amount of heat that must be added to this LNG as it is dispensed to obtain the optimum results. In this case, the residual fuel in the tank prior to refill is assumed to be at the desired saturation level:

$$\text{Volume of liquid to add}=(V*\rho(P_{sat})-M(LL))/(\rho(P_{stored}))$$

$$\text{Heat to add}=(h_f(P_{sat})-h_f(P_{stored}))*(V*\rho(P_{sat})-M(LL))$$

Where:

V is the volume of the vehicle tank

M(LL) is the mass of natural gas in the tank as determined by the level data $P_{sat}$ is the desired saturation pressure $P_{stored}$ is the current saturation pressure of the fuel to be delivered $\rho(X)$ is the density of LNG at the desired saturation pressure $h_f(X)$ is the specific enthalpy of the liquid at the specified pressure ($P_{sat}$ or $P_{stored}$)

Microprocessor 82 controls valve 54 and a pump controller 90 so that the amount of LNG dispensed to the vehicle fuel tank and the amount of heat added thereto via heat exchanger 52 may be controlled as dictated by the above calculations.

The dispensing of the LNG and addition of heat may be accomplished in stages. More specifically, unheated, and therefore very cold, LNG is preferably initially dispensed to the vehicle fuel tank so that the vapor head therein is collapsed. As a result, the temperature and pressure of the vehicle tank are lowered rapidly at the beginning of the fill so that the pressure demands placed upon pump 30 and the fill time are minimized. Heat may then be added to the stream of LNG, via heat exchanger 52, as it is dispensed prior to the completion of the fill such that the LNG in the fuel tank reaches the saturation temperature to recreate the required operating pressure when the fill is completed. Microprocessor 82 must therefore also calculate the quantity of heat required and duration of heating that is to occur as the LNG is dispensed. Optimally, at the completion of the fill, the LNG in the fuel tank would be exactly at the lowest saturation temperature required for the operating pressure of the vehicle. In embodiments where the vehicle tank includes a temperature sensor, the microprocessor 82 may optionally monitor the temperature of the LNG in the vehicle tank so that when the temperature of the LNG in the tank drops below a predetermined level, heat is added to the LNG being dispensed.

Figure 3:
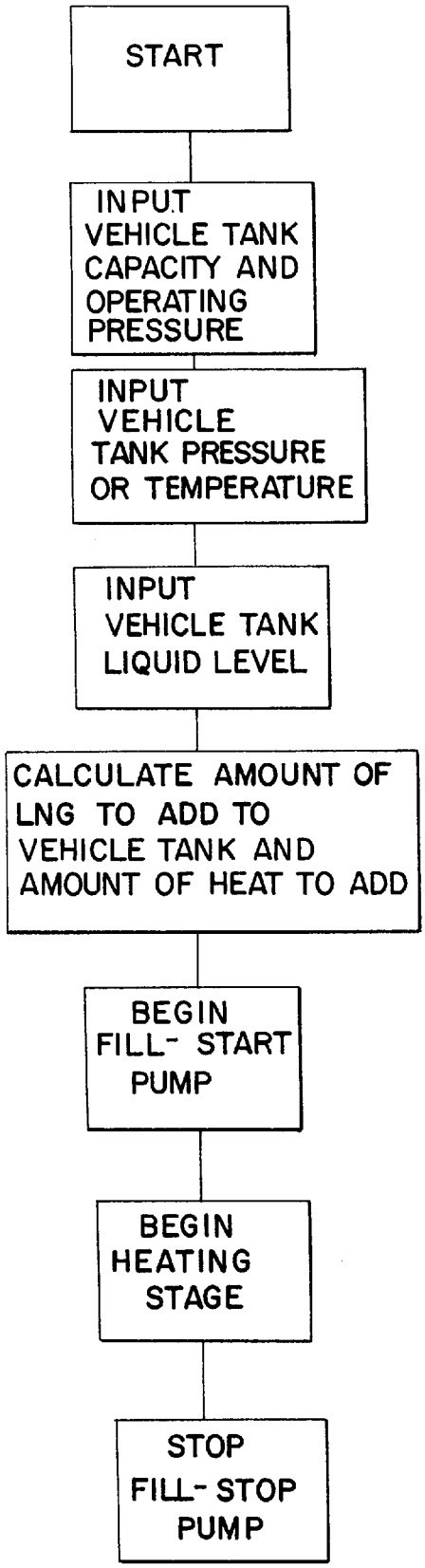
FIG. 3 is a flow chart illustrating the logic performed by the microprocessor of FIG. 2.

FIG. 3 presents a flow chart illustrating an example of the logic for the microprocessor 82 whereby the system may perform the necessary calculations and then dispense and heat the LNG in stages as described above. Because microprocessor 82 receives inputs for the specific vehicle tank to be refilled, the system easily accommodates a variety of vehicles and initial tank conditions.

As an example of operation of the system of the invention, a situation is presented where the vehicle tank has a capacity of 100 gallons and is initially 50% full and the station has LNG stored at a pressure of 20 psig. If the initial pressure of the LNG in the vehicle tank is measured to be 110 psig (via a pressure sensor or derived from temperature sensor data), and the desired saturation pressure is 100 psig, 45.6 gallons of LNG and 4761 BTU's of heat would need to be added to the vehicle tank, according to the above equations. In the situation where there are no pressure or temperature sensors in communication with the vehicle tank, an assumption is made that the liquid initially in the vehicle tank (which is 50% full) is at the desired saturation pressure of 100 psig. Based upon the above equations, 45.6 gallons of LNG and 5217 BTU's of heat should be added to the vehicle tank. In both examples, unheated LNG would be initially delivered to the vehicle tank for a time period of 1 to 2 minutes with heating of the LNG occurring for the remainder of the fill.

Figure 4:
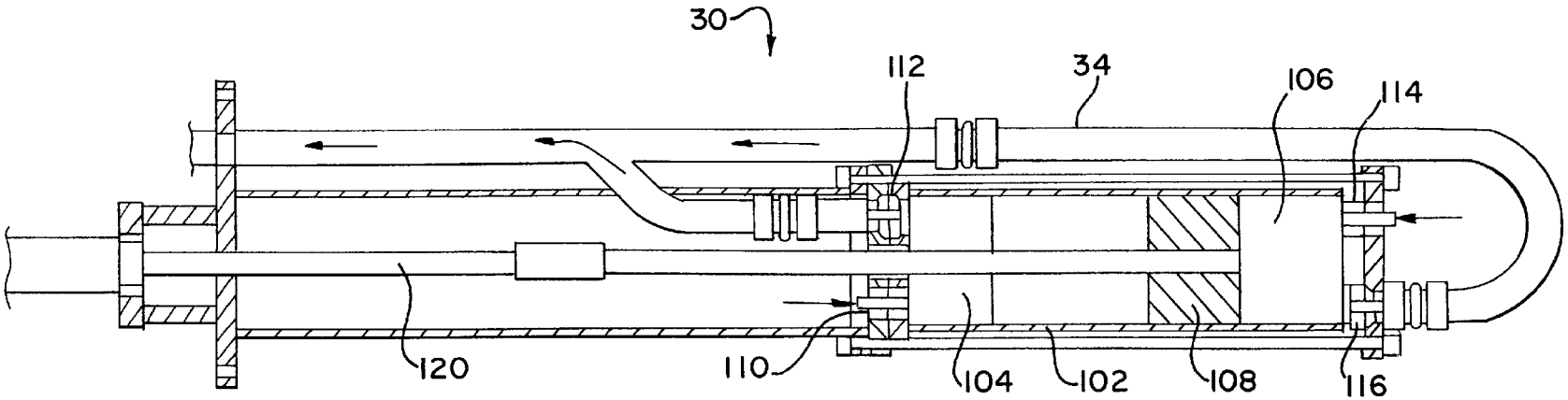
FIG. 4 is an enlarged sectional side elevation view of the pump of FIG. 2.

A positive displacement pump suitable for use with the dispensing system of the present invention is indicated in general at 30 in FIG. 4. The positive displacement pump 30 includes a cylinder housing 102 which contains a pumping cylinder that is divided into a pair of pumping chambers 104 and 106 by a sliding piston 108. Pumping chamber 104 includes inlet check valve 110 and outlet check valve 112. Similarly, chamber 106 includes inlet check valve 114 and outlet check valve 116.

In operation, LNG from sump 24 (FIG. 2) enters and is discharged from the pump chambers 104 and 106 during alternating intake and discharge strokes of piston 108. More specifically, as the piston 108 moves to the right in FIG. 3, LNG is drawn into chamber 104 through inlet check valve 110 while LNG is simultaneously discharged from chamber 106 through outlet check valve 116. When the piston 108 moves to the left in FIG. 3, LNG is drawn into chamber 106 through check valve 114 and discharged from chamber 104 through check valve 112. Pumped LNG travels through common line 34 to meter 36 (FIG. 2).

Piston 108 is connected by a rod 120 to a hydraulic system, an electric motor or some other variable speed device that moves the piston in the cylinder. As a result, the number of strokes per minute of the piston may be adjusted so that the pump may produce a variety of flow rates. The pressure output of the pump may be increased by increasing the power delivered to the piston 108. While a positive displacement pump is preferred in the dispensing system of the invention, it should be understood that a centrifugal pump could also be used. Such a centrifugal pump would need to include suitable pressure controls.

Figure 5:
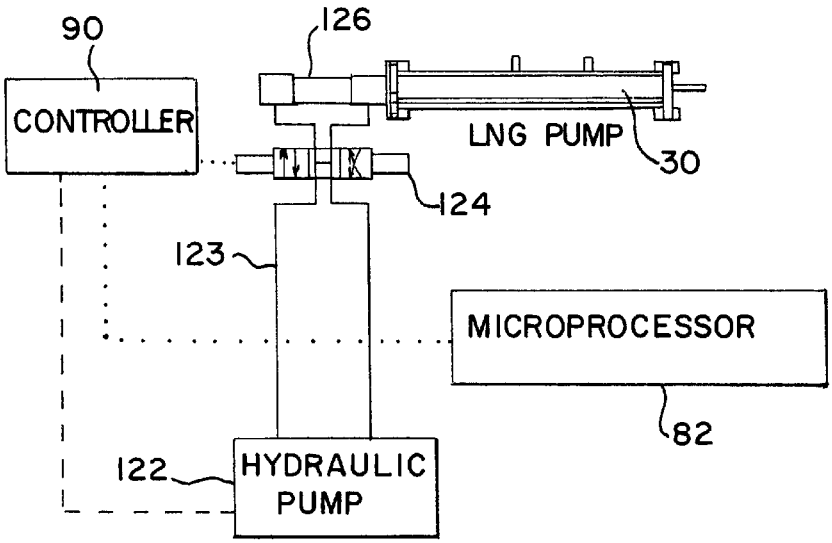
FIG. 5 is a schematic view of a system for powering the pump of FIG. 4.

An example of a hydraulic system suitable for driving the piston of the pump 30 is illustrated in FIG. 5. A hydraulic pump provides hydraulic fluid in an alternating fashion via lines 123 and automated valves 124 to opposite sides of a drive piston (not shown) enclosed in drive housing 126. As a result, the drive piston, which is connected to the rod 120 of FIG. 4, reciprocates so as to drive the piston 108 (FIG. 4) of pump 30. As described above, microprocessor 82 communicates with pump controller 90 to control the pressure and flow rate produced by the pump 30. The controller 90 communicates with the automated valves 124 and the hydraulic pump 122 to accomplish this function.

Figure 6:
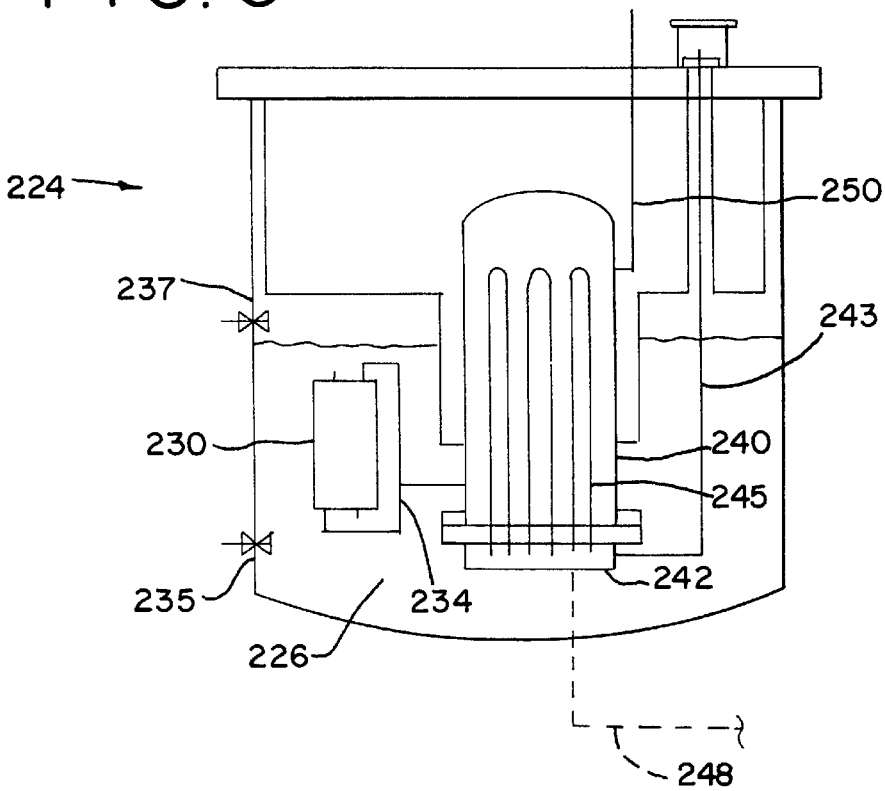
FIG. 6 is a sectional side elevation view of the sump of a second embodiment of the dispensing system of the present invention.

The sump of an alternative embodiment of the dispensing system of the present invention is illustrated in general at 224 in FIG. 6. In this alternative embodiment, an electrical heater is used in place of the heat exchanger 52 of FIG. 2 to heat the LNG as it is dispensed. The insulated feed line 22 of FIG. 2 leading from the LNG bulk storage tank connects to the sump 224 via valve 235 while the insulated vent line 28 communicating with the head space of the bulk storage tank connects to the sump via valve 237.

The pump 230, which may be of the type illustrated in FIGS. 3 and 4, is submerged in the LNG 226 in the sump and supplies LNG to a heater 240 via line 234. The heater 240 includes an electric immersion preheater 242 and heating elements 245 that receive power through electrical line 243. As a result, the heater 240, which is controlled via connection 248 by the system microprocessor (82 in FIG. 2), supplies the desired amount of heat to the LNG pumped out of the sump and into the vehicle fuel tank through line 250. It is to be understood that as an alternative to the arrangement illustrated, an electric heater may be positioned outside of the sump in association with line 250.

Figure 7:
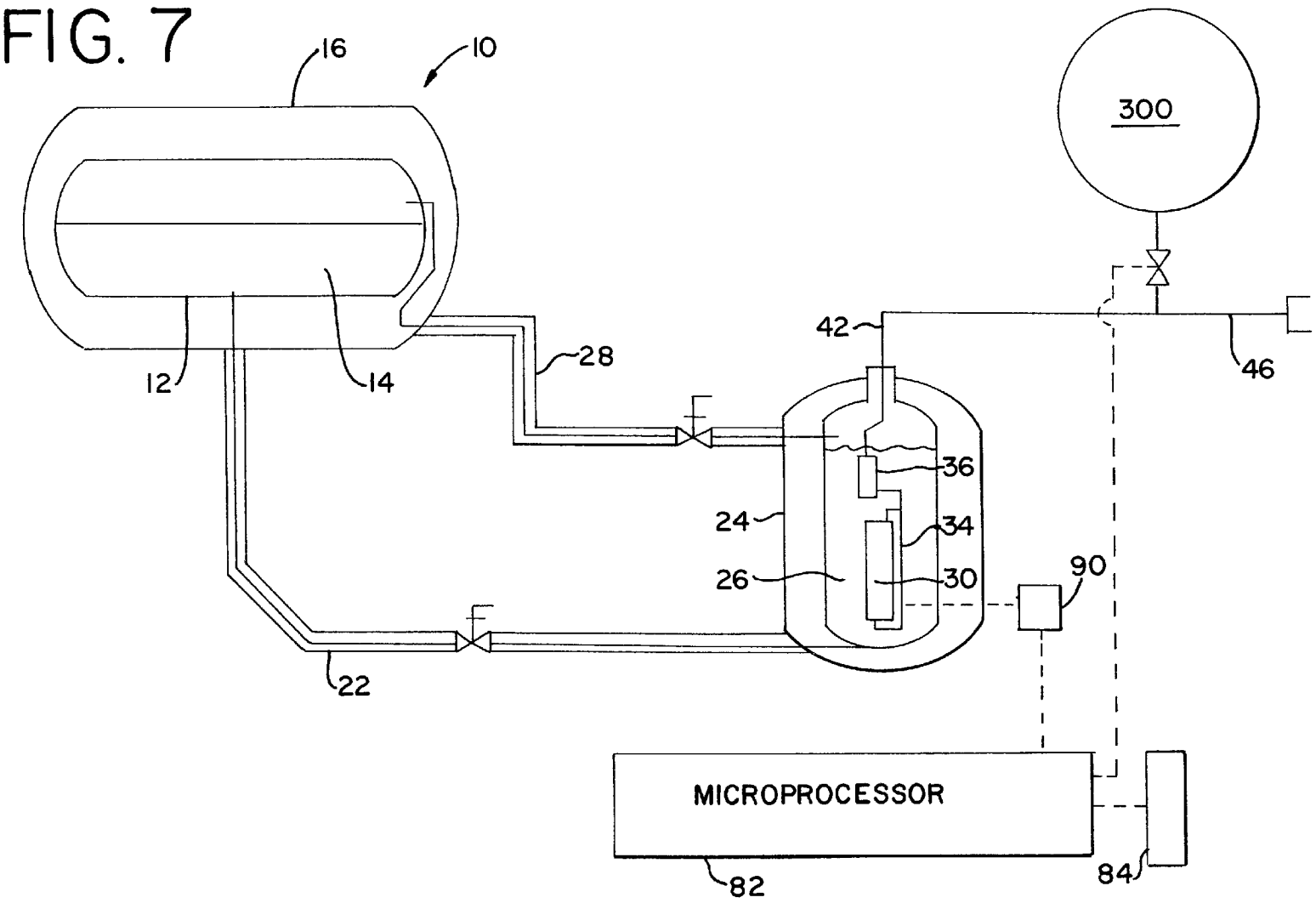
FIG. 7 is a schematic view of a third embodiment of dispensing system of the present invention.

Another embodiment of the dispensing system of the present invention is illustrated in FIG. 7 where components shared with the embodiment of FIG. 2 are indicated with common reference numbers. In FIG. 7, a high pressure supply of natural gas at ambient temperature 300 is substituted for the heat exchanger 52 and line 44 of FIG. 2 and selectively communicates with dispensing line 46 via valve 302. Valve 302 is controlled via microprocessor 82 and the natural gas introduced thereby is recondensed within the liquid flowing through line 46. The resulting temperature increase in the liquid is proportional to the amount of gas recondensed.

While the preferred embodiments of the invention have been shown and described, it will be apparent to those skilled in the art that changes and modifications may be made therein without departing from the spirit of the invention, the scope of which is defined by the appended claims.

What is claimed is:

1. A system for dispensing cryogenic liquid to a vehicle-mounted tank having sensors for determining a liquid level and a pressure or temperature in the tank comprising:

a) a bulk storage tank containing a supply of cryogenic liquid;

b) a pump in communication with the bulk storage tank;

c) a dispensing line in communication with the pump so that cryogenic liquid may be pumped from the bulk storage tank to the vehicle-mounted tank;

d) a heater in operative relation with the dispensing line;

e) an interface in communication with the tank sensors so that conditions of cryogenic liquid initially in the vehicle-mounted tank may be determined; and f) a system control device in communication with the tank sensors via said interface, said pump and said heater so that appropriate amounts of cryogenic liquid and heat may be determined and added to the vehicle-mounted tank based upon the initial conditions in the vehicle-mounted tank so that the vehicle-mounted tank becomes substantially filled with cryogenic liquid at a desired saturated level.

2. The system of claim 1 wherein said pump is a positive displacement pump.

3. The system of claim 1 wherein said heater includes a heat exchanger.

4. The system of claim 3 wherein said heater also includes a valve positioned between the heat exchanger and the dispensing line with the system control device in communication with the valve so that the heat exchanger may selectively be placed in communication with the dispensing line.

5. The system of claim 4 wherein said dispensing line includes a venturi positioned in parallel with the heat exchanger so that cryogenic liquid is forced to the heat exchanger when the valve is at least partially open.

6. The system of claim 1 wherein said heater includes an electrical heating element.

7. The system of claim 1 wherein said heater includes a supply of cryogenic gas.

8. The system of claim 7 wherein said heater further comprises a valve positioned between the supply of cryogenic gas and the dispensing line with the valve in communication with the system control device so that cryogenic gas may be selectively added to cryogenic liquid flowing through the dispensing line.

9. The system of claim 1 further comprising a sump at least partially filled with cryogenic liquid and wherein said pump is positioned within said sump and submersed in the cryogenic liquid.

10. The system of claim 1 wherein said interface uses radio frequency transmission.

11. The system of claim 1 wherein said interface uses infrared transmission.

12. A system for dispensing cryogenic liquid to a use device tank comprising:

a) a bulk storage tank containing a supply of cryogenic liquid;

b) a dispensing line in communication with the bulk storage tank, said dispensing line adapted to communicate with the use device tank;

c) a pump in circuit with said dispensing line;

d) a heater in circuit with said dispensing line;

e) a system control device in communication with said pump and said heater so that cryogenic liquid may be selectively dispensed to the use device tank and selectively heated as it is dispensed to the use device tank;

f) a liquid level sensor in communication with the use device tank and the system control device so that a liquid level of cryogenic liquid initially in the use device tank may be determined by said system control device;

g) an additional sensor in communication with the use device tank and the system control device, said additional sensor communicating data from the use device tank so that a temperature and pressure for the cryogenic liquid initially in the use device tank may be determined by said system control device;

h) said system control device calculating from the liquid level and data from the sensors the amount of heat and cryogenic liquid that must be added to the use device tank to generally fill the use device tank with saturated cryogenic liquid, said system control device then operating the heater and pump to generally fill the use device tank with saturated cryogenic liquid.

13. The system of claim 12 wherein said pump is a positive displacement pump.

14. The system of claim 12 wherein said heater includes a heat exchanger.

15. The system of claim 14 wherein said heater also includes a valve positioned between the heat exchanger and the dispensing line with the system control device in communication with the valve so that the heat exchanger may selectively be placed in communication with the dispensing line.

16. The system of claim 14 wherein said dispensing line includes a venturi positioned in parallel with the heat exchanger so that cryogenic liquid is forced to the heat exchanger when the valve is at least partially open.

17. The system of claim 12 wherein said heater includes an electrical heating element.

18. The system of claim 12 wherein said heater includes a supply of cryogenic gas.

19. The system of claim 18 wherein said heater further comprises a valve positioned between the supply of cryogenic gas and the dispensing line with the valve in communication with the system control device so that cryogenic gas may be selectively added to cryogenic liquid flowing through the dispensing line.

20. The system of claim 12 further comprising a sump at least partially filled with cryogenic liquid and wherein said pump is positioned within said sump and submersed in the cryogenic liquid.

21. The system of claim 12 wherein said additional sensor is a pressure sensor for determining a pressure of the cryogenic liquid initially in the use device tank.

22. The system of claim 12 wherein said additional sensor is a temperature sensor for determining a temperature of the cryogenic liquid initially in the use device tank.

23. A method of dispensing cryogenic liquid to a use device tank comprising the steps of:

a) determining an initial liquid level and other condition data for cryogenic liquid initially in the use device tank;

b) determining a total capacity of the use device tank;

c) determining a desired final pressure for cryogenic liquid in the use device tank;

d) determining a saturation temperature for the desired final pressure determined in step c); and e) using the information determined in steps a)–d) to calculate the amount of cryogenic liquid that must be dispensed to the use device tank and the amount of heat that must be added to the cryogenic liquid as it is dispensed so that the use device tank becomes generally filled with cryogenic liquid at the desired final pressure and saturation temperature.

24. The method of claim 23 wherein the other condition data of step a) is a pressure of the cryogenic liquid initially in the use device tank.

25. The method of claim 23 wherein the other condition data of step a) is a temperature of the cryogenic liquid initially in the use device tank.

26. The method of claim 23 further comprising the steps of:

f) dispensing a portion of the amount of cryogenic liquid calculated in step e) to the use device tank; and g) adding the heat calculated in step e) to the remaining portion of the amount of cryogenic liquid calculated in step e) as it is dispensed to the use device tank.

27. A system for dispensing cryogenic liquid to a vehicle-mounted tank having a sensor for determining a liquid level in the tank comprising:

a) a bulk storage tank containing a supply of cryogenic liquid;

b) a pump in communication with the bulk storage tank;

c) a dispensing line in communication with the pump so that cryogenic liquid may be pumped from the bulk storage tank to the vehicle-mounted tank;

d) a heater in operative relation with the dispensing line;

e) an interface in communication with the liquid level sensor so that a level of cryogenic liquid initially in the vehicle-mounted tank may be determined; and f) a system control device in communication with the liquid level sensor via said interface, said pump and said heater so that appropriate amounts of cryogenic liquid and heat may be determined and added to the vehicle-mounted tank based upon the initial liquid level in the vehicle-mounted tank so that the vehicle-mounted tank becomes substantially filled with cryogenic liquid at a desired saturated level.

28. The system of claim 27 wherein said pump is a positive displacement pump.

29. The system of claim 27 wherein said heater includes a heat exchanger.

* * * * *